US010092950B2

(12) United States Patent
Segaud et al.

(10) Patent No.: US 10,092,950 B2
(45) Date of Patent: Oct. 9, 2018

(54) DEVICE FOR DIE CASTING A METAL COMPONENT

(71) Applicant: Bayerische Motoren Werke Aktiengesellschaft, Munich (DE)

(72) Inventors: Jean-Marc Segaud, Landshut (DE); Richard Schaechtl, Pfeffenhausen (DE); Lucas Schulte-Vorwick, Landshut (DE); Hubert Lang, Landshut (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 12 days.

(21) Appl. No.: 15/272,487

(22) Filed: Sep. 22, 2016

(65) Prior Publication Data

US 2017/0008078 A1 Jan. 12, 2017

Related U.S. Application Data

(63) Continuation of application No. PCT/EP2015/054458, filed on Mar. 4, 2015.

(30) Foreign Application Priority Data

Mar. 24, 2014 (DE) ..... 10 2014 205 388

(51) Int. Cl.
*B22D 17/08* (2006.01)
*B22D 17/20* (2006.01)
(Continued)

(52) U.S. Cl.
CPC ..... *B22D 17/08* (2013.01); *B22D 17/203* (2013.01); *B22D 17/2023* (2013.01);
(Continued)

(58) Field of Classification Search
CPC ..... B22D 17/2023; B22D 17/2272; B22D 17/08; B22D 17/203; B22D 17/2281; B22D 17/30; B22D 17/32
See application file for complete search history.

(56) References Cited

U.S. PATENT DOCUMENTS 4,086,953 A * 5/1978 Kraklau ..... B22D 17/2023 164/312
5,711,363 A * 1/1998 Scruggs ..... B22D 17/00 164/113
(Continued)

FOREIGN PATENT DOCUMENTS

CN 1572395 A 2/2005
CN 202114235 U 1/2012
(Continued)

OTHER PUBLICATIONS

English machine translation of JP 2000-33467.*
(Continued)

*Primary Examiner* — Kevin P Kerns
*Assistant Examiner* — Steven S Ha
(74) *Attorney, Agent, or Firm* — Crowell & Moring LLP

(57) ABSTRACT

A device for die casting a metal component included a die casting mold which has a cavity that forms the component. The cavity is connected to a source for a metal melt by at least one temperature controlled supply channel. The metal melt is introduced into the cavity via at least one casting valve. The supply channel forms an annular channel, in which metal melt can be circulated via a conveying apparatus.

19 Claims, 6 Drawing Sheets

(51) Int. Cl.
*B22D 17/22* (2006.01)
*B22D 17/30* (2006.01)
*B22D 17/32* (2006.01)

(52) U.S. Cl.
CPC ..... *B22D 17/2272* (2013.01); *B22D 17/2281* (2013.01); *B22D 17/30* (2013.01); *B22D 17/32* (2013.01)

(56) References Cited

U.S. PATENT DOCUMENTS

| | | | | |
|---|---|---|---|---|
| 2004/0151799 | A1 | 8/2004 | Gellert et al. | |
| 2005/0022958 | A1 | 2/2005 | Hirai et al. | |
| 2007/0277953 | A1* | 12/2007 | Ward | B22D 17/007 164/113 |
| 2014/0345824 | A1* | 11/2014 | Fahrenbach | B22D 17/30 164/113 |
| 2014/0345825 | A1 | 11/2014 | Gaebges et al. | |
| 2015/0151357 | A1 | 6/2015 | Wunderle et al. | |

FOREIGN PATENT DOCUMENTS

| | | | |
|---|---|---|---|
| CN | 202291259 | U | 7/2012 |
| DE | 1 290 672 | | 3/1969 |
| DE | 44 44 092 | A1 | 4/1996 |
| DE | 103 59 692 | A1 | 7/2004 |
| DE | 10 2012 010 923 | A1 | 12/2013 |
| DE | 10 2013 105 433 | B3 | 5/2014 |
| EP | 2 835 192 | A1 | 2/2015 |
| JP | 2000033467 | A * | 2/2000 |
| WO | WO 02/26426 | A1 | 4/2002 |

OTHER PUBLICATIONS

Chinese-language Office Action issued in counterpart Chinese Application No. 201580003246.7 dated Jan. 17, 2017 with English translation (Seventeen (17) pages).

International Search Report (PCT/ISA/210) issued in PCT Application No. PCT/EP2015/054458 dated Jul. 6, 2015, with English translation (four (4) pages).

German-language Written Opinion (PCT/ISA/237) issued in PCT Application No. PCT/EP2015/054458 dated Jul. 6, 2015 (five (5) pages).

German Search Report issued in counterpart German Application No. 10 2014 205 388.9 dated Dec. 11, 2014, with partial English translation (ten (10) pages).

* cited by examiner

DEVICE FOR DIE CASTING A METAL COMPONENT

CROSS REFERENCE TO RELATED APPLICATIONS

This application is a continuation of PCT International Application No. PCT/EP2015/054458, filed Mar. 4, 2015, which claims priority under 35 U.S.C. § 119 from German Patent Application No. 10 2014 205 388.9, filed Mar. 24, 2014, the entire disclosures of which are herein expressly incorporated by reference.

BACKGROUND AND SUMMARY OF THE INVENTION

The present invention relates to a device for die casting a metal component.

Die casting is an industrial casting method for the mass production of components. For this purpose, use is generally made of metal materials having a low melting point, such as, for example, aluminum and magnesium.

During the die casting, metal melt is pressed under a high pressure of approx. 10 to 200 MPa and with a high mold filling speed of up to 120 m/s into the cavity of a die casting mold where said metal melt then solidifies. The operation is carried out here with a permanent mold, i.e. without a pattern.

In particular, components which are comparatively large and are shaped in a geometrically complex manner and are produced by means of die casting require a comparatively large sprue system. This is understood as meaning supply channels which connect the casting chamber to the cavity of the die casting mold. The material in the sprue system solidifies together with the material forming the actual component and has to be subsequently removed. This constitutes a considerable processing outlay.

In many cases, the ratio of the mass of the component being produced to the sprue mass is one to greater than one (1:>1). Therefore, during the die casting, more material waste is produced than material is used for the component. This is uneconomical for a number of reasons. Firstly, significantly more material has to be melted for each component than is actually required for the component. Furthermore, the material waste has to be disposed of after separation or remelted for recycling. Furthermore, the supply channels are generally configured with comparatively large flow diameters in order to keep the cooling of the melt in the sprue system and the flow resistance as little and as low as possible. However, as a consequence of the configuration with the large volume, the melt generally solidifies significantly later in the sprue system than in the cavity of the die casting mold itself. The cycle times which can be achieved are therefore constrained by the time required for the material in the sprue system to solidify. Furthermore, the sprue system results in an increase in the size of the die casting mold and in the closing forces required for closing the two-part die casting mold, and therefore in the plant outlay.

The disadvantages caused by the sprue system of a die casting device may, in principle, also occur in the technologically similar injection molding of plastics. However, this can be avoided by designing an injection molding device with a "hot channel system". In such an injection molding device, the sprue system is controlled to a higher temperature than, and thermally insulated from, the rest of the injection molding die. This prevents the material from solidifying in the sprue system. The material is therefore available for the injection molding of a subsequent component. Valves which are arranged in the transition from the sprue system to the cavity decouple the solidifying material in the cavity from the material in the sprue system and permit the demolding of the solidified component without the sprue. By means of the thus achieved ending of solidified sprue on the component, the disadvantages mentioned above can be avoided.

It has already been contemplated to transfer the hot channel system known from the injection molding of plastics to a device for die casting metal components, see DE 44 44 092 A1. However, a practical implementation of this concept has failed up to now. Reasons therefore reside in particular in the considerable stressing of the plant parts involved by means of the metal melt. In particular, the high temperatures of the metal melt of approx. 620° C. to 750° C. and the sometimes considerable temperature differences both between a cold non-operational state and a hot operational state of the entire device and also between individual plant parts in the operational state play a role here. Also, the aggressivity of, for example, an aluminum melt to other metals makes it difficult to implement a hot channel system for die casting metal components.

Starting from this prior art, it is the object of the invention to implement a hot channel system, which is known in principle from the injection molding of plastics and is implemented in practice, for the die casting of metal components.

The above object is achieved by a device for die casting a metal component with a die casting mold. In the case of the device for die casting a metal component, comprising a die casting mold which has a cavity molding the component, wherein the cavity is connected to a source for a metal melt via at least one temperature-controlled supply channel, and wherein the metal melt is introduced into the cavity via at least one casting valve, it is provided according to the invention that the supply channel forms an annular channel in which metal melt can be circulated by way of a conveying apparatus.

A series of advantages can be generated by the formation of the supply channel as an annular channel. In particular, this permits the permanent conveying of the material located in the supply channel, even when no material is specifically being introduced into the cavity, as is the case, for example, during the curing of the material in the cavity in order to form the component, or during the demolding of the component. Permanent conveying and therefore movement of the material in the supply channel ensures thorough mixing and thereby also prevents local curing of the material in the supply channel.

A further advantage which can be realized by the configuration of the device according to the invention resides in the fact that the pressure conditions in the supply channel can be better influenced because of the annular configuration. This applies in particular whenever, as is preferably provided, more than one conveying apparatus is provided. Influencing the pressure conditions in the supply channel may be advantageous in particular if, as is preferably provided, a plurality of casting valves are arranged distributed along the supply channel.

The metal melt can be, in particular, a melt of a light metal, in particular aluminum or magnesium, or of an alloy comprising such a light metal.

It can preferably be provided that the supply channel is integrated in a stationary part of the die casting mold. The die casting mold then also has at least one mobile part which is removable from the stationary part in order to permit demolding of the component. By integration of the supply channel in the stationary part, it is possible to avoid decoupling of the supply channel from the die casting mold in order to open the latter.

In a further aspect of the device according to the invention, it can be provided that the source for the metal melt includes a holding chamber and a metal melt reservoir connected separably to the holding chamber. The separation of the source for the metal melt into a holding chamber and a metal melt reservoir makes it possible to isolate a defined quantity of the metal melt in order to subsequently introduce a corresponding quantity of the metal melt into the cavity in order to die cast the component.

By way of the separation of the defined quantity, only the quantity and the metal melt contained in the supply channel has to be placed under pressure for the die casting, whereas the possibly significantly larger quantity of metal melt accommodated in the metal melt reservoir can be stored, for example, at atmospheric pressure. Accordingly, it is provided, in a further aspect of the device according to the invention, that the metal melt contained in the holding chamber can be discharged into the supply channel by way of pressure-generating devices. The pressure-generating devices can preferably be at least one piston which can be designed so as to be displaceable, in particular hydraulically, in order to change the volume of the holding chamber.

In order to obtain a separable connection between the holding chamber and the metal melt reservoir, an activatable valve may be provided which closes or at least partially opens up a transfer opening formed between the holding chamber and the metal melt reservoir as required.

It can preferably be provided that the supply channel leads into the holding chamber at at least two points. As a result, the holding chamber can advantageously be integrated in a circulation of the metal melt in the supply channel. This can, in particular, also have a positive influence on the introduction of the metal melt into the cavity via a plurality of casting valves since the flow paths of the metal melt from the holding chamber to the individual casting valves can thus be kept comparatively short.

In a further aspect of the device according to the invention, it can be provided that the supply channel is formed in at least one portion from pipe pieces, in particular rectilinear pipe pieces, and from connecting pieces connecting the pipe pieces. This refinement makes it possible to form a supply channel which is constructed in a simple manner and, at the same time, can compensate for the considerable loads which are exerted on the components forming the supply channel by the metal melt, in particular the different thermally induced elongations. In order to connect the pipe pieces to the connecting pieces, it can be provided that the ends of the pipe pieces are inserted into corresponding receiving openings of the connecting pieces. A defined longitudinal movability of the ends of the pipe pieces in the receiving openings is provided in order to be able to compensate for different thermally induced elongations of the pipe pieces and of the connecting pieces.

It can preferably be provided that at least some of the connecting pieces integrate a channel portion with a curved profile and/or a casting valve. Curved portions of the supply channel and functional elements of the device are therefore preferably integrated in the connecting pieces, which are optionally formed with a larger volume.

The latter also afford the possibility of good integration of a heating device in order to actively heat the connecting pieces and therefore the metal melt guided within the corresponding supply channel portion and therefore to keep the same fluid. In contrast thereto, it can be provided that the pipe pieces of the supply channel are heated passively, i.e. by the metal melt itself flowing through the pipe pieces.

In order to keep the thermally induced elongation of the pipe pieces and of the connecting pieces as identical as possible, it can preferably be provided to form at least a large part of each of the pipe pieces and the connecting pieces from the same material. In particular, a ceramic material, such as, for example, aluminum titanate and/or silicon nitride, can be used as material for the pipe pieces and/or for the connecting pieces.

In a further aspect of the device according to the invention, it can be provided that the conveying apparatus is designed so as to act electromagnetically. The conveying apparatus is therefore designed in such a manner that moving magnetic fields are generated which bring about the movement of the metal melt by magnetic force action. This makes it possible to position all of the parts of the conveying apparatus outside the metal melt. As a result, positioning conveying elements, such as, for example, a pump impeller, within the metal metal can be avoided.

A casting valve for a device according to the invention can preferably have a valve body which is movable transversely with respect to, and in particular perpendicularly to, the longitudinal axis of the supply channel and, in a closed position, closes an outlet opening connecting the supply channel to the cavity and, in an open position, at least partially opens up the outlet opening. In the case of such a casting valve, the formation of "dead water points", in which it is possible for metal melt to accumulate that would not be carried along by the circulated metal melt, is avoided.

In a preferred refinement of the casting valve, it can be provided that a valve seat is formed for the valve body which is designed so as to widen in the direction of the supply channel. At the same time, a head of the valve body can be designed so as to taper in the direction of the cavity. As a result, advantageous flow conditions in the open position of the valve body and a good sealing action in the closed position of the valve body can be achieved. At the same time, the risk of the valve body jamming in the valve seat is small.

By way of recompaction of the metal melt introduced into the cavity, the quality of the component being produced can be positively influenced in a known manner. In particular, a reduction of pores and air locks can thereby be achieved. In principle, a device for the recompaction of the metal melt introduced into the cavity can be implemented at a plurality of suitable points of the casting mold. However, integration of a squeezing plunger, which is movable into a position projecting into the cavity, in the casting valve and in particular in the valve body can be advantageous. As a result, for example, the squeezing plunger can be moved into a sprue system which is in any case present between the outlet of the casting valve and the cavity of the casting mold (but is very small in volume according to the invention). This not only avoids an additional surface defect on the component, which is produced by the squeezing plunger, but optionally also further reduces the volume of the sprue system and therefore a sprue remaining on the component.

The valve body and/or the squeezing plunger can be actively actuable independently of each other preferably in both directions (retraction and extension). For this purpose, at least one corresponding regulating device can be provided which, particularly preferably, can be designed so as to act hydraulically. Furthermore preferably, it can be provided to thermally insulate the regulating device(s) from the supply channel in order to keep the thermal loading of the regulating device by a transmission of heat from the metal melt guided in the supply channel as small as possible. The thermal insulation can be implemented, for example, by a structural separation with an intermediate arrangement of insulating elements or else air-filled intermediate spaces.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
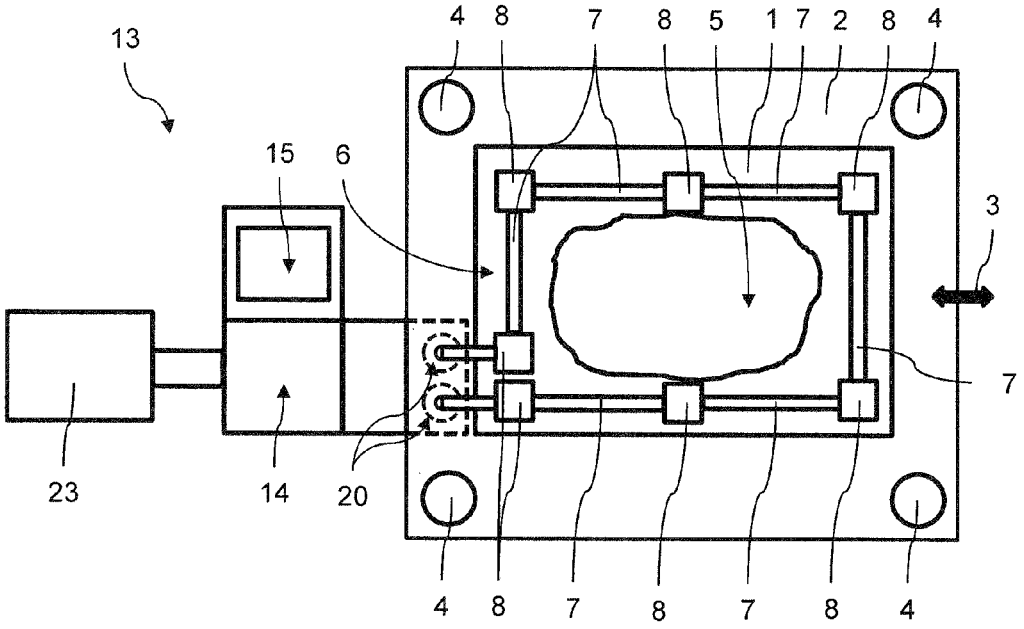
FIG. 1 is schematic top view of an exemplary device according to the invention for die casting a metal component.

FIG. 1 shows schematically a device for die casting a metal component. The device includes a die casting mold 1 which can be stored exchangeably in a press device 2. For the exchange, the die casting mold 1 can be moved out of or into the press device, for example along the double arrow 3. The die casting mold 1 has a lower part which is illustrated in FIG. 1 and is fixedly connectable to a stationary part (illustrated in FIG. 1) of the press device 2, and an upper part (not illustrated) which is fixedly connectable to a mobile part (not illustrated) of the press device 2. By movement of the mobile part of the press device 2 by way of hydraulic cylinders 4, the die casting mold can be closed, wherein the upper part of the die casting mold 1 then rests on the lower part of the die casting mold 1 in a sealing manner. A substantially closed cavity 5, which constitutes the negative mold of the component to be produced, is formed centrally here within the die casting mold 1. By moving the mobile part of the press device 2, the die casting mold 1 can be opened after the die casting and solidifying of the component, and the component can therefore be demolded.

A supply channel 6 for metal melt, from which the component is intended to be die cast, is integrated in the die casting mold 1, in a manner surrounding the cavity 5. The integration preferably takes place here in the stationary lower part of the die casting mold 1. The integration of the supply channel 6 in the die casting mold 1 can be provided in an exchangeable manner, for example by the corresponding elements (pipe pieces 7 and connecting pieces 8) of the supply channel 6 being arranged exchangeably in corresponding receiving openings or receiving depressions of a basic body of the die casting mold 1.

The supply channel 6 is composed of rectilinear pipe pieces 7 and connecting pieces 8. As can be seen from FIG. 4, the connection between the pipe pieces 7 and the connecting pieces 8 takes place by inserting an end of a pipe piece 7 adjacent to a connecting piece 8 into a corresponding receiving opening in the connecting piece 8. It can be provided here that the receiving openings have a defined excess size both in the radial and in the longitudinally axial direction of the pipe pieces 7 in order to compensate for a thermally induced elongation of said elements that occurs during operation. Sealing of the between the outer side of the inserted ends of the pipe pieces 7 and the inner walls of the corresponding receiving openings can take place by means of a separate sealing element 9, for example in the form of a metal O ring, in particular a "Wills ring".

Channel portions 10 with a profile curved by 90° are integrated in the connecting pieces 8 arranged in the corners of the encircling supply channel 6. A respective casting valve 11 is integrated in the two centrally arranged connecting pieces 8. The casting valves 11 serve to introduce the metal melt contained in the supply channel 6 into the cavity 5 in a defined manner during the die casting of the component. If the cavity 5 is filled, the latter is separated from the supply channel 6 by closing of the casting valves 11. As a result, the metal melt contained in the cavity 5 can cure independently of the metal melt contained in the supply channel 6, and the component can be demolded after curing.

In order to avoid curing of the metal melt in the supply channel 6, the connecting pieces 8 are actively heated. For this purpose, the latter each include a heating device (not illustrated). The heating device can be operated in particular electrically. By contrast, no active heating is provided for the pipe pieces 7 (but is possible). The pipe pieces are therefore heated exclusively passively by transmission of heat from the metal melt, and are thereby brought to a temperature which approximately corresponds to that of the connecting pieces 8. In order to reduce a transmission of heat to the environment, the pipe pieces 7 in particular, but optionally also the connecting pieces 8, may be provided with thermal insulation on the outer side.

Figure 4:
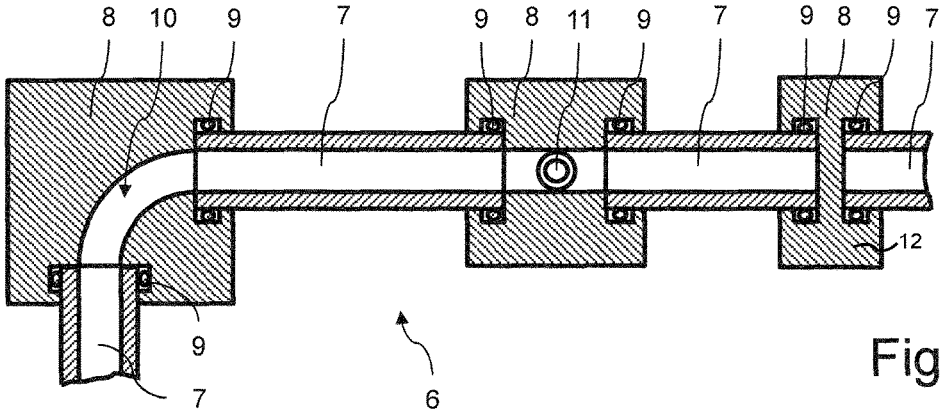
FIG. 4 shows part of the supply channel of the device according to FIG. 1 in a horizontal section.

FIG. 4 also illustrates a connecting piece 8 which serves merely as a connecting socket 12 for two pipe pieces, and therefore neither integrates a curved channel portion 10 nor a casting valve 11. Such a connecting piece 8 can serve in particular to keep the length of the individual pipe pieces 7 connected thereto small.

It can preferably be provided to form the pipe pieces 7 and the connecting pieces 8 from the same material as far as possible. In particular, a ceramic material, such as, for example, aluminum titanate and/or silicon nitride, is suitable for this purpose. Such a ceramic material can be distinguished in particular by good high temperature stability and good chemical stability in relation to the metal melt (in particular in the case of an aluminum metal melt).

Figure 3:
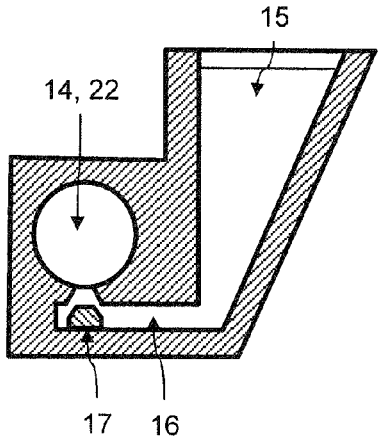
FIG. 3 shows a cross section through the illustration of FIG. 2 along the sectional plane

The device furthermore also includes a holding and supply part 13. A source for the metal melt is integrated therein. The source includes a holding chamber 14, which is temperature controlled by, in particular, an electric heating device, and a metal melt reservoir 15. The holding chamber 14 is connected to the metal melt reservoir 15 in a fluid conducting manner via an overflow line 16 (c.f. FIG. 3), wherein the fluid conducting connection is closable as required by means of an activatable melt valve 17, as a result of which a pressure proof separation can be achieved between the holding chamber 14 and the metal melt reservoir 15.

Figure 2:
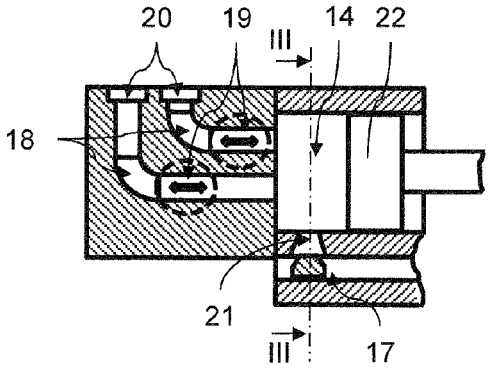
FIG. 2 shows part of the device according to FIG. 1 in a longitudinal section.

The holding chamber 14 is connected via two likewise temperature controlled connecting portions 18 (c.f. FIG. 2) of the supply channel 6 to that portion of the supply channel 6 which is formed in the die casting mold 1. A conveying apparatus 19 is integrated in each of the connecting portions 18. The conveying apparatuses are designed as electromagnetic circulating pumps. The connecting portions 18 are connected via preferably automatically releasable coupling devices 20 to that portion of the supply channel 6 which is integrated in the die casting mold 1.

In the present exemplary embodiment, the metal melt reservoir 15 is designed as a container which is open on its upper side and can be filled in a known manner via, for example, a metering ladle or a metering furnace. The overflow line 16 emerges from the bottom of metal melt reservoir 15 and leads to an overflow opening 21 which opens at a lowest point into the cylindrically designed holding chamber 14. The overflow opening 21 is closed or opened up by means of a casting plunger 22 depending on the switching position of the melt valve 17.

In a starting position of the device, in which the supply channel 6 is not yet filled with metal melt, the holding chamber 14 is first of all pre-filled. For this purpose, the melt valve 17 is opened, as a result of which the holding chamber 14 is filled by the hydrostatic pressure of the metal melt contained in the metal melt reservoir 15. For this purpose, in order to achieve as complete a filling of the holding chamber 14 as possible, the level in the metal melt reservoir 15 should always be at least as high as the highest point of the holding chamber 14. Venting of the holding chamber 14 during the pre-filling with metal melt can take place via the supply channel 6 and the open casting valves 11 (or one or more separate venting valves (not illustrated)). Furthermore, an operation of the conveying apparatuses 19, in which the two conveying apparatuses convey in the direction of the holding chamber 14 (i.e. "in reverse"), prevents metal melt that enters the holding chamber 14 from the metal melt reservoir 15 from overflowing via the connecting portions 18 into that portion of the supply channel 6 which is integrated in the die casting mold 1, and therefore a substantially complete pre-filling of the holding chamber 14 can be achieved.

Subsequently, the supply channel 6 can be filled with the metal melt. For this purpose, the melt valve 17 is reopened and at the same time the two conveying apparatuses 19 are switched in such a manner that they convey metal melt in the direction of the supply channel 6 (i.e. "forward"). In this case, the pre-filling of the holding chamber 14 ensures uninterrupted sucking up of metal melt from the metal melt reservoir 15. During the filling of the supply channel 6, the conveying apparatuses 19 can be driven at full power, which can lead to filling of the supply channel 6 with the metal melt under a pressure of, for example, at maximum 5 bar. As soon as the supply channel 6 is filled, one of the conveying apparatuses 19 continues to be operated forward at a reduced power of, for example, 20%, while the second conveying apparatus 19 continues to convey forward at an increased, for example full, power. This circuit of the conveying apparatuses 19 is referred to below as a "circulation circuit". The circulation circuit of the conveying apparatuses 19 gives rise to a pressure difference between the two connecting portions 18 of the supply channel 6. The pressure difference ensures a constant circulation of the metal melt in the supply channel 6 forming an annular channel (together with the holding chamber 14).

For the die casting of a component, when the holding chamber 14 and supply channel 6 are filled, a casting plunger 22 is extended by way of an, in particular, hydraulic drive 23 in such a manner that the metal melt contained in the holding chamber 14 and the supply channel 6 is placed under pressure. The casting valves 11 are then opened and the quantity of metal melt required for the casting is pushed into the supply channel 6 via the casting plunger 22. After complete filling of the cavity 5 with the metal melt, the casting valves 11 close again. The circulation circuit of the conveying apparatuses 19 remains activated during the die casting.

The holding chamber 14 can subsequently be filled again in order to prepare the die casting of a further component. For this purpose, the melt valve 17 is opened and the casting plunger 22 moved back such that metal melt, assisted by the hydrostatic pressure, is sucked out of the metal melt reservoir 15 into the holding chamber 14. The holding chamber 14 is filled here with a quantity of metal melt which approximately corresponds to the quantity of the material required for the component. The volume and therefore the quantity of metal melt which can be introduced into the holding chamber 14 are adjustable via the position of the moved back casting plunger 22. If the holding chamber 14 is completely filled, the melt valve 17 is closed. During the refilling of the holding chamber 14, the circulation circuit of the conveying apparatuses 19 likewise remains activated. By means of the conveying of the two conveying apparatuses 19 in a forward direction, it can be avoided that the supply channel 6 is partially emptied during the refilling of the holding chamber 14, and the melt required for filling the holding chamber 14 is on the contrary sucked exclusively out of the metal melt reservoir 15.

Before a longer lasting interruption of the operation of the device, the supply channel 6, the holding chamber 14 and optionally also the metal melt reservoir 15 should be emptied. For this purpose, the two conveying apparatuses 19 are switched in reverse, and the melt valve 17 and, for ventilation purposes, the casting valves 11 (or the separate venting valves) are opened. The metal melt is then conveyed into the metal melt reservoir 15 by means of the conveying apparatuses 19. The metal melt reservoir 15 and also the holding chamber 14 can be completely emptied by opening an outlet valve integrated in the overflow line 16. The emptied die casting mold 1 can be automatically decoupled and moved out of the press device 2.

The actuation of a casting valve 11 within the context of the die casting of a component is illustrated in FIGS. 5*a* to 5*f* in six steps or switching positions.

Figure 5A:
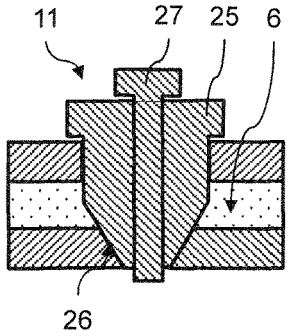
FIGS. 5*a* to 5*f* show various positions of a casting valve of the device according to FIG. 1 within the context of die casting a metal component.
Figure 5B:
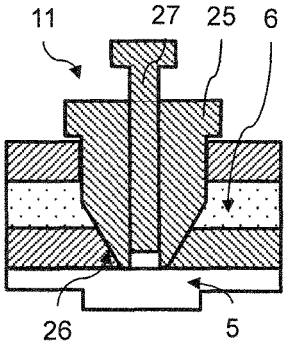

FIG. 5*a* shows the switching position of the casting valve 11, in which the latter is located while the cavity 5 of the die casting mold 1 is being prepared for the die casting. The cavity can be cleaned and sprayed with a releasing agent. A valve body 25 of the casting valve 11 is located here in a position closing an outlet opening 26 of the casting valve 11. Furthermore, a squeezing plunger 27 is positioned in a position extended in the direction of the cavity 5. The squeezing plunger 27 projects here beyond the valve body 25 into a sprue portion 28 of the cavity 5.

Figure 5C:
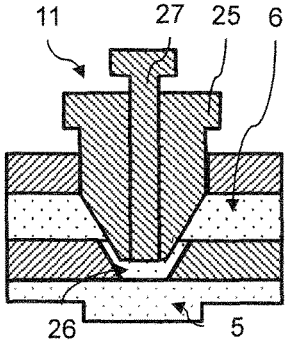
Figure 5D:
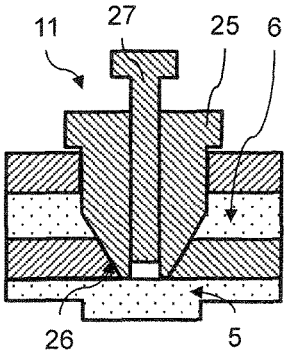

For the die casting, the squeezing plunger 27 is first of all moved into a drawn back position (cf. FIG. 5*b*) and subsequently the valve body 25 is also moved into an open position (cf. FIG. 5*c*).

After the complete filling of the cavity 5 with the metal melt, the valve body 25 is first of all closed (cf. FIG. 5*d*) and subsequently the squeezing plunger 27 is extended (cf. FIG. 5*e*). As a result, the metal melt is recompacted in the cavity 5, which is beneficial in a known manner for the quality of the die cast component.

Figure 5E:
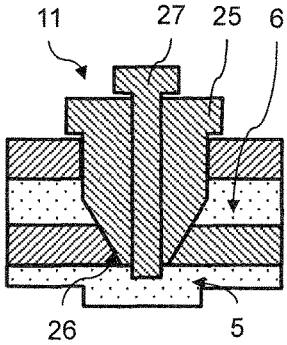
Figure 5F:
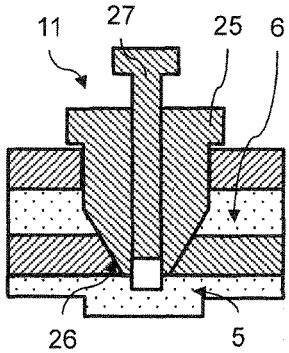
Figure 7:
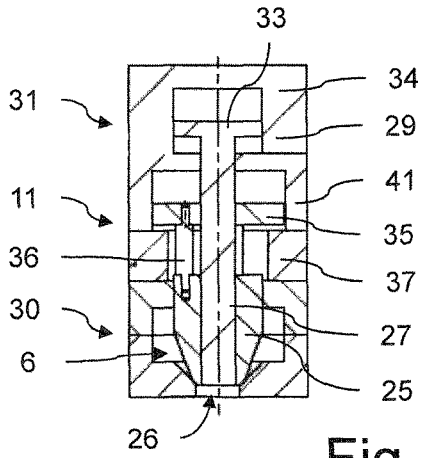
FIG. 7 shows a section through the casting valve according to FIG. 6 along the sectional plane VII-VII.
Figure 6:
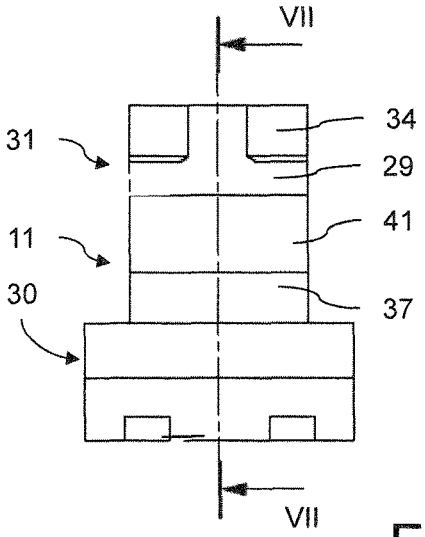
FIG. 6 shows a casting valve for a device according to FIG. 1 in a side view.
Figure 8:
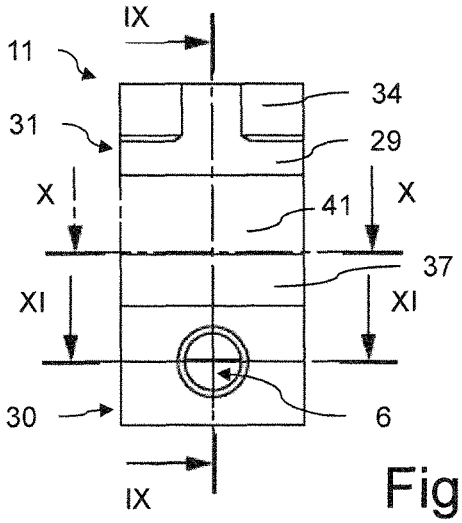
FIG. 8 shows the casting valve according to FIGS. 6 and 7 in a front view.
Figure 9:
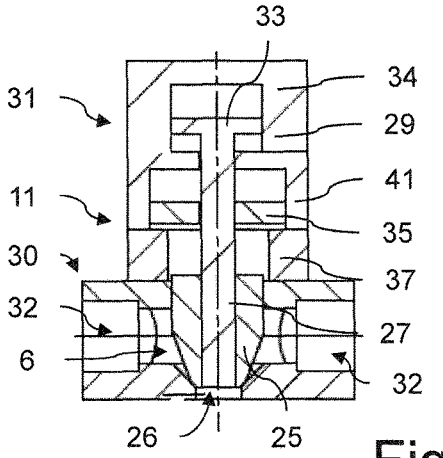
FIG. 9 shows a section through the casting valve according to FIG. 8 along the sectional plane IX-IX.
Figure 10:
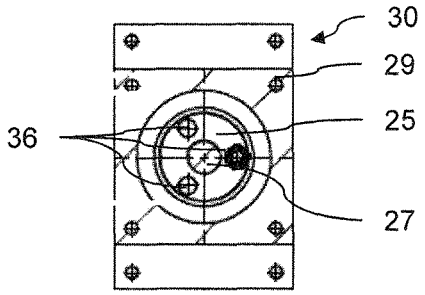
FIG. 10 shows a section through the casting valve according to FIG. 8 along the sectional plane X-X.
Figure 11:
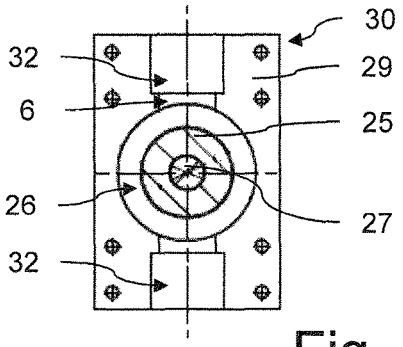
FIG. 11 shows a section through the casting valve according to FIG. 8 along the sectional plane XI-XI.

The switching position according to FIG. 5*e* is maintained until the material solidifies in the cavity 5 and has cooled in a defined manner and can therefore be demolded. For the demolding, the squeezing plunger 27 is moved into the drawn back position (cf. FIG. 5*f*).

A possible configuration of the casting valve 11 is shown in various views and sectional illustrations in FIGS. 6 to 11.

The casting valve 11 includes a housing 29 which may be a housing of the corresponding connecting piece 8 of the supply channel 6 or which is integrated in an additional housing of such a connecting piece 8. The housing 29 has two housing parts 30, 31.

A first housing part 30 has, in integrated form, a first through opening, which forms a portion of the supply channel 6, and two receiving openings 32 which serve for receiving one end in each case of a pipe piece 7 of the supply channel 6 (cf. FIG. 4). Furthermore, a second through opening is integrated in the first housing part 30, the second through opening running perpendicularly to the first through opening and, in one portion, forming the outlet opening 26 of the casting valve 11 and, in another portion, serving for guiding the movable valve body 25. A portion of the outlet opening 26 that lies adjacent to the first through opening is designed so as to taper conically in the direction of the cavity 5. This portion of the outlet opening 26 serves as a valve seat for the valve body 25. The front end of the latter, which faces the outlet opening 26, is likewise designed so as to taper conically. It can be provided here that the angle which the conical lateral surface of the valve body 25 encloses with the longitudinal axis of the valve body 25 is smaller than the angle which the conical wall portion of the outlet opening 26 encloses with the longitudinal axis of the outlet opening. Furthermore, it can be provided that the conical portion of the lateral surface of the valve body 25 and/or the conical wall portion of the outlet opening 26 have/has a slightly curved profile, as a result of which a secure bearing of the valve body 25 over the complete circumference in the valve seat can be ensured.

A second housing part 31 includes two regulating devices in the form of coaxially oriented hydraulic cylinders. A first hydraulic cylinder situated closer to the first housing part serves for moving the valve body 25 while the squeezing plunger 27 is movable via the second hydraulic cylinder. For this purpose, that end of the squeezing plunger 27 which is spaced apart from the cavity 5 is connected directly to a plunger 33 which can be displaced within a cylinder tube 34 by the generation of a pressure difference on the two sides separate from the plunger 33. The first hydraulic cylinder likewise includes a plunger 35 which is displaceable by the generation of a pressure difference within a cylinder tube 41 of the first hydraulic cylinder. The plunger 35 which is in the shape of an annular disk is guided movably here on the squeezing plunger 27 which therefore extends through the first hydraulic cylinder, but without functionally influencing the latter. The plunger 35 of the first hydraulic cylinder is connected to the valve body 25 via three rods 36 positioned at a uniform pitch about the squeezing plunger 27.

Via an intermediate piece 37 which connects the two housing parts 30, 31 and is composed of a thermally comparatively readily insulating material, a transmission of heat from the metal melt guided in the first housing part 30 via the first housing part 30 to the second housing part 31 and the hydraulic cylinders integrated therein is kept small.

FIGS. 12 to 20 show different alternative embodiments for casting valves 11 which can be used in the device according to the invention according to FIG. 1.

Figure 12A:
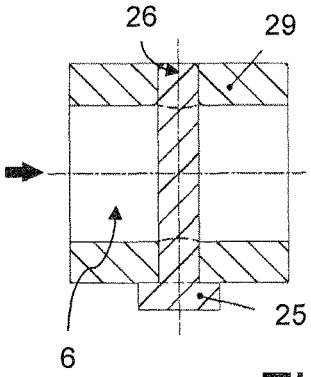
FIGS. 12*a* and 12*b* show a longitudinal section through an alternative embodiment of a casting valve for a device according to FIG. 1 in two switching positions.
Figure 12B:
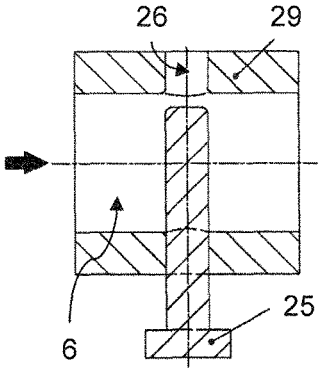

FIGS. 12*a* and 12*b* show a casting valve 11 in which a cylindrical valve body 25 is mounted movably perpendicularly to the longitudinal axis of that portion of the supply channel 6 which is formed by a housing 29 of the casting valve 11. The outlet opening 26 of the casting valve 11 is formed cylindrically with an inside diameter approximately corresponding to the outside diameter of the valve body 25. In the closed position, the valve body 25 closes the outlet opening 26 by means of radial contact with the inner wall thereof (cf. FIG. 12*a*).

Figure 13A:
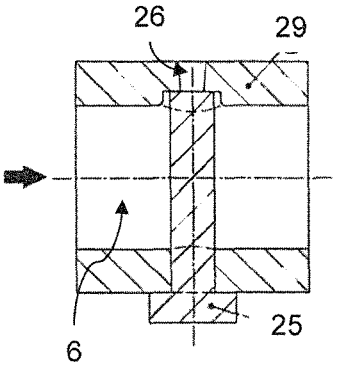
FIGS. 13*a* and 13*b* show a longitudinal section through an alternative embodiment of a casting valve for a device according to FIG. 1 in two switching positions.
Figure 13B:
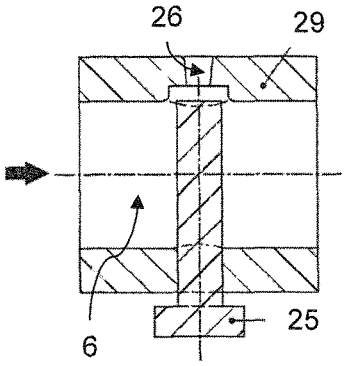

The casting valve 11 illustrated in FIGS. 13*a* and 13*b* differs from the casting valve 11 illustrated in FIGS. 12*a* and 12*b* in the configuration of the outlet opening 26 and of the valve seat formed by the latter. The outlet opening 26 is of stepped design and has a first portion adjacent to the cavity 5, in which the inside diameter is smaller than the outside diameter of the valve body 25. Located adjacent to the supply channel 6 is a second portion of the outlet opening 26, in which the inside diameter is slightly larger than the outside diameter of the valve body 25. In the closed position of the valve body 25, the latter therefore bears on the end side against the shoulder formed between the two portions of the outlet opening 26.

Figure 14A:
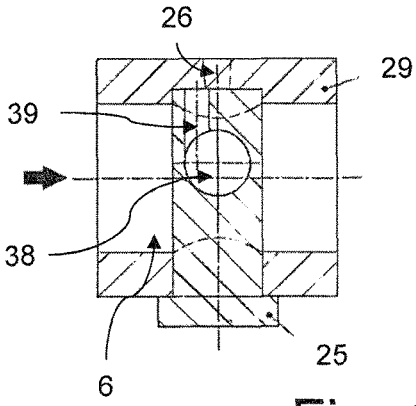
FIGS. 14*a* and 14*b* show a longitudinal section through an alternative embodiment of a casting valve for a device according to FIG. 1 in two switching positions.
Figure 14B:
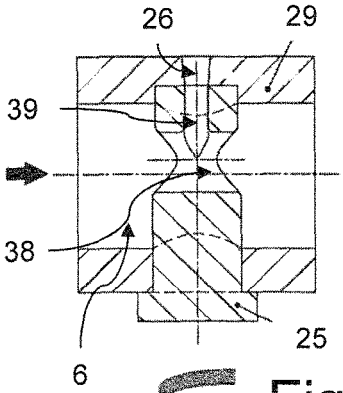

In the case of the valve illustrated in FIGS. 14*a* and 14*b*, the valve body 25 is arranged perpendicularly to the longitudinal axis of that portion of the supply channel 6 which is formed by the housing 29. The valve body 25 has a first through opening 38 extending in the direction of the longitudinal axis of the portion of the supply channel 6. From the first through opening 38, a second through opening 39 emerges in an eccentric arrangement with an orientation extending perpendicularly to the longitudinal axis of the first through opening 38. In the open rotational position of the valve body 25, the second through opening 39 merges into the outlet opening 26, as a result of which the supply channel 6 is connected in a fluid conducting manner to the outlet opening 26 via the two through openings 38, 39.

In the case of all of the casting valves 11 illustrated in FIGS. 5 to 14, the maximum outside diameter of the valve body 25 is smaller than the width or the diameter of that portion of the supply channel 6 which is formed by the casting valve 11. As a result, the metal melt can flow continuously around the valve body 11, and therefore a continuous circulation of the flow of the metal melt in the supply channel 6 forming an annular channel is made possible.

Figure 15:
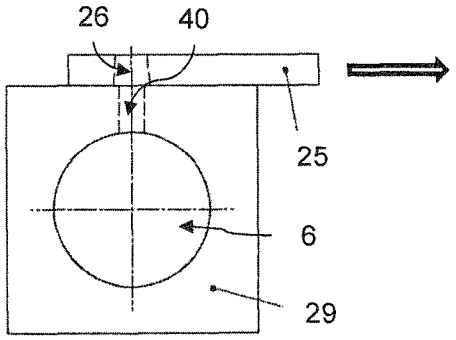
FIG. 15 shows a front view of an alternative embodiment of a casting valve for a device according to FIG. 1.
Figure 16:
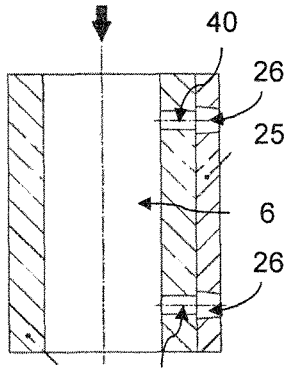
FIG. 16 shows the casting valve according to FIG. 15 in a longitudinal section.

The casting valve 11 illustrated in FIGS. 15 and 16 includes a valve body 25 in the form of a displaceable valve plate arranged on the outer side of the housing 29 of the casting valve 11. For the casting valve 11, two (merely by way of example) outlet openings 26 are provided which are arranged offset in the direction of the longitudinal axis of that portion of the supply channel 6 which is formed by the casting valve 11, and which, in an open position of the valve plate, overlap with a respective through opening 40 in the valve plate. Displacement of the valve plate into a closed position leads to a covering of the outlet openings 26 by the valve plate.

Figure 17A:
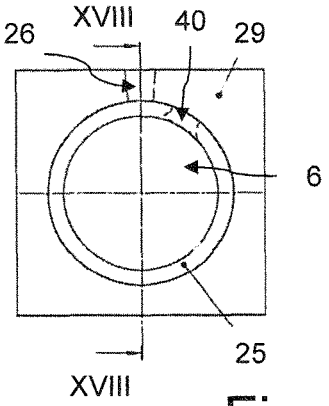
FIGS. 17*a* and 17*b* show a front view through an alternative embodiment of a casting valve for a device according to FIG. 1 in two switching positions.
Figure 18A:
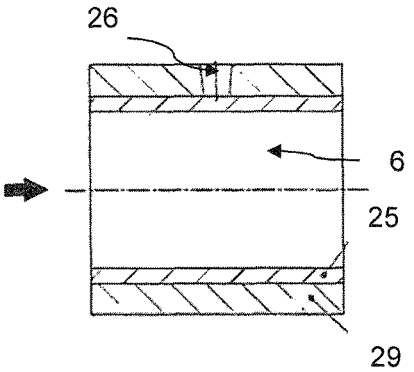
FIGS. 18*a* and 18*b* show longitudinal sections through the casting valve according to FIGS. 17*a* and 17*b* in the two switching positions along the sectional plane XVIII-XVIII.
Figure 17B:
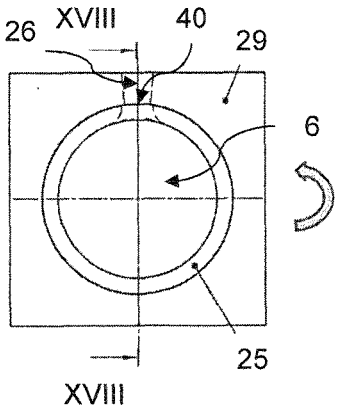
Figure 18B:
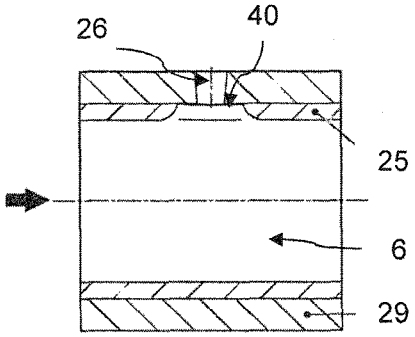

In the case of the casting valve 11 illustrated in FIGS. 17 and 18, use is made of a bushing shaped valve body 25 which bears against the wall of that portion of the supply channel 6 which is formed by the casting valve 11. The bushing-shaped valve body 25 has a radially running through opening 40 which overlaps with the outlet opening 26 in an (opening) rotational position. By rotation of the bushing shaped valve body 25 about the longitudinal axis of the portion of the supply channel 6 by, for example, approx. 30°, the through opening 40 is brought out of overlapping with the outlet opening 26 and the casting valve is therefore closed.

Figure 19A:
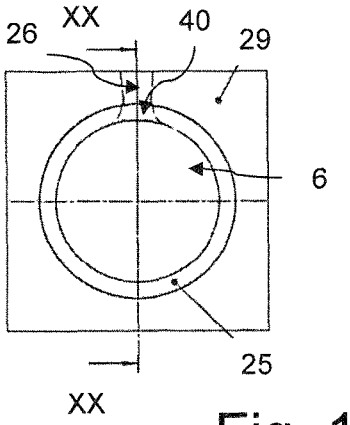
FIGS. 19*a* and 19*b* show a front view through an alternative embodiment of a casting valve for a device according to FIG. 1 in two switching positions.
Figure 20A:
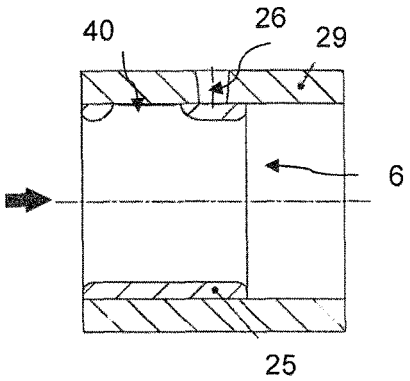
FIGS. 20*a* and 20*b* show longitudinal sections through the casting valve according to FIGS. 17*a* and 17*b* in the two switching positions along the sectional plane XX-XX.
Figure 19B:
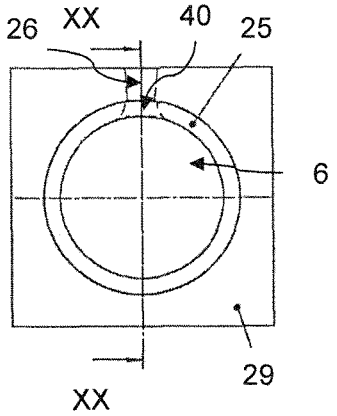
Figure 20B:
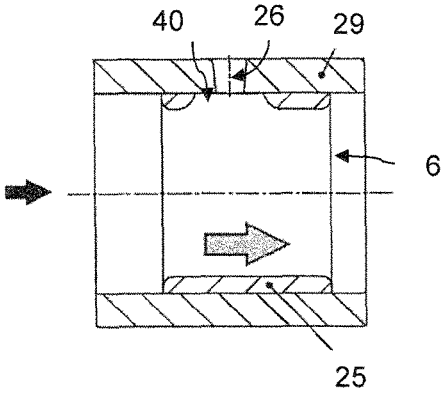

The casting valve 11 illustrated in FIGS. 19 and 20 likewise includes a bushing shaped valve body 25 with a through opening 40 which can be brought into overlap with the outlet opening 26, wherein, in this case, the opening or closing of the casting valve 11 is brought about by displacement of the bushing shaped valve body 25 in the direction of the longitudinal axis of that portion of the supply channel 6 which is formed by the casting valve 11.

LIST OF REFERENCE NUMBERS

1 Die casting mold
2 Press device
3 Movement directions during the exchanging of the die casting mold
4 Hydraulic cylinder
5 Cavity
6 Supply channel
7 Pipe piece
8 Connecting piece
9 Sealing element
10 Curved channel portion
11 Casting valve
12 Connecting socket
13 Holding and supply part
14 Holding chamber
15 Metal melt reservoir
16 Overflow line
17 Melt valve
18 Connecting portion
19 Conveying apparatus
20 Coupling device
21 Overflow opening
22 Casting plunger
23 Drive of the casting plunger
25 Valve body of the casting valve
26 Outlet opening
27 Squeezing plunger
28 Sprue portion
29 Housing of the casting valve
30 First housing part
31 Second housing part
32 Receiving openings
33 Plunger of the second hydraulic cylinder
34 Cylinder tube of the second hydraulic cylinder
35 Plunger of the first hydraulic cylinder
36 Rod
37 Intermediate piece
38 First through opening
39 Second through opening
40 Through opening
41 Cylinder tube of the first hydraulic cylinder The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for die casting a metal component, comprising:
- a die casting mold having a cavity that forms the component;
- a supply channel connecting the cavity with a source of metal melt, wherein the supply channel is temperature controlled and wherein the supply channel is formed, in at least one portion, from pipe pieces and connecting pieces that connect the pipe pieces; and
- a casting valve by which the metal melt is introduced into the cavity, wherein the supply channel forms an annular channel in which the metal melt is circulatable via a conveying apparatus and wherein the annular channel encircles the cavity.

2. The device according to claim 1, wherein the supply channel is integrated in a stationary part of the die casting mold.

3. The device according to claim 1, wherein the source of the metal melt comprises:
- a holding chamber; and
- a metal melt reservoir connected separably to the holding chamber.

4. The device according to claim 3, wherein the metal melt contained in the holding chamber is dischargable into the supply channel by a pressure generating device.

5. The device according to claim 3, wherein the supply channel leads into the holding chamber at at least two points.

6. The device according to claim 1, wherein the connecting pieces integrate channel portions having a curved profile.

7. The device according to claim 1, wherein the connecting pieces integrate a plurality of casting valves.

8. The device according to claim 1, wherein the pipe pieces and the connecting pieces are formed from a same material.

9. The device according to claim 1, wherein the connecting pieces are heatable.

10. The device according to claim 1, wherein the conveying apparatus is configured to act electromagnetically.

11. The device according to claim 1, wherein:
- the casting valve has a valve body movable transversely with respect to a longitudinal axis of the supply channel, in a closed position of the valve body, the valve body closes an outlet opening connecting the supply channel to the cavity, and in an open position of the valve body, the valve body at least partially opens up the outlet opening.

12. The device according to claim 11, wherein the outlet opening is configured to widen in a direction of the supply channel, and a portion of the valve body is configured to taper in a direction of the cavity.

13. The device according to claim 12, wherein the casting valve integrates a squeezing plunger movable into a position projecting into the cavity.

14. The device according to claim 11, wherein the casting valve integrates a squeezing plunger movable into a position projecting into the cavity.

15. The device according to claim 1, wherein the supply channel is a heated supply channel.

16. A device for die casting a metal component, comprising:

a die casting mold having a cavity that forms the component;

a supply channel connecting the cavity with a source of metal melt, wherein the supply channel is temperature controlled;

a casting valve by which the metal melt is introduced into the cavity, wherein the supply channel forms an annular channel in which the metal melt is circulatable via a conveying apparatus and wherein the annular channel encircles the cavity;

wherein:

the casting valve has a valve body movable transversely with respect to a longitudinal axis of the supply channel, in a closed position of the valve body, the valve body closes an outlet opening connecting the supply channel to the cavity, and in an open position of the valve body, the valve body at least partially opens up the outlet opening; and a regulating device for the valve body, the regulating device being thermally insulated from the supply channel.

17. The device according to claim 16, wherein the regulating device is configured to act hydraulically.

18. A device for die casting a metal component, comprising:

a die casting mold having a cavity that forms the component;

a supply channel connecting the cavity with a source of metal melt, wherein the supply channel is temperature controlled;

a casting valve by which the metal melt is introduced into the cavity, wherein the supply channel forms an annular channel in which the metal melt is circulatable via a conveying apparatus and wherein the annular channel encircles the cavity;

wherein:

the casting valve has a valve body movable transversely with respect to a longitudinal axis of the supply channel, in a closed position of the valve body, the valve body closes an outlet opening connecting the supply channel to the cavity, and in an open position of the valve body, the valve body at least partially opens up the outlet opening;

wherein the casting valve integrates a squeezing plunger movable into a position projecting into the cavity; and a regulating device for the squeezing plunger, the regulating device being thermally insulated from the supply channel.

19. The device according to claim 18, wherein the regulating device is configured to act hydraulically.

* * * * *